US006420970B1

(12) United States Patent
Kampmann et al.

(10) Patent No.: US 6,420,970 B1
(45) Date of Patent: Jul. 16, 2002

(54) EMERGENCY EXIT DOOR WITH AN EMERGENCY DOOR OPENING SYSTEM WITH A CONTROL BOX HAVING AN EMERGENCY DOOR OPENING BUTTON AND DISPLAY MODULE

(75) Inventors: Manfred Kampmann, Herdecke; Axel Schmidt, Ennepetal; Armin Heese, Reichshof, all of (DE)

(73) Assignee: Dorma GmbH + Co. KG, Ennepetal (DE)

( * ) Notice: Subject to any disclaimer, the term of this patent is extended or adjusted under 35 U.S.C. 154(b) by 0 days.

(21) Appl. No.: 09/532,449

(22) Filed: Mar. 23, 2000

Related U.S. Application Data

(63) Continuation-in-part of application No. PCT/EP99/05388, filed on Jul. 27, 1999.

(30) Foreign Application Priority Data

Jul. 28, 1998 (DE) ..... 198 34 013

(51) Int. Cl.[7] ..... G08B 13/00

(52) U.S. Cl. ..... 340/541; 340/540; 340/545.1; 340/545.7

(58) Field of Search ..... 340/541, 542, 340/545.1, 543, 545.7

(56) References Cited

U.S. PATENT DOCUMENTS 4,178,708 A * 12/1979 Fletcher et al. ..... 40/451
4,631,528 A * 12/1986 Handel et al. ..... 340/545
4,763,937 A * 8/1988 Sittnick, Jr. et al. ..... 292/251.5
5,065,136 A * 11/1991 Frolov et al. ..... 340/545
5,311,168 A * 5/1994 Pease, Jr. et al. ..... 340/542

FOREIGN PATENT DOCUMENTS

| | | |
|---|---|---|
| DE | 2314567 | 10/1974 |
| DE | 8607155 | 6/1988 |
| DE | 9408898 | 11/1995 |
| DE | 19531323 | 4/1996 |
| DE | 19545274 | 6/1997 |
| DE | 19652348 | 6/1998 |
| EP | 0592926 | 4/1994 |

* cited by examiner

*Primary Examiner*—Jeffery Hofsass
*Assistant Examiner*—Son Tang
(74) *Attorney, Agent, or Firm*—Nils H. Ljungman & Associates

(57) ABSTRACT

An improved emergency door with an emergency door opening system having a control box comprising a housing with a cylinder lock, an emergency door opening button, and an audio alarm sensor to provide an optimized user-friendly and customer-friendly arrangement of optical display elements that can be easily assembled with the emergency door. This is achieved by surrounding the emergency door opening button with a display module which can be closed by a covering frame that is provided with integrated safety glass.

20 Claims, 9 Drawing Sheets

EMERGENCY EXIT DOOR WITH AN EMERGENCY DOOR OPENING SYSTEM WITH A CONTROL BOX HAVING AN EMERGENCY DOOR OPENING BUTTON AND DISPLAY MODULE

CONTINUING APPLICATION DATA

This application is a Continuation-In-Part application of International Patent Application No. PCT/EP99/05388, filed on Jul. 27, 1999, which claims priority from Federal Republic of Germany Patent Application No. DE 198 34 013.3, filed on Jul. 28, 1998. International Application No. PCT/EP99/05388 was pending as of the filing date of the above-cited application. The United States was an elected state in International Application No. PCT/EP99/05388.

BACKGROUND OF THE INVENTION

1. Field of the Invention

The present invention may relate to an emergency door opening system with a housing in which may be located a shaped cylinder with a corresponding electrical circuit, an emergency door opening button in connection with a switch block to disarm a locking device, and an acoustical alarm transmitter.

2. Background Information

Door systems of this type are used in the form of a compact device for emergency exits in a controlled-access environment. An emergency door system of this type is marketed under the name "DORMA TL-G". In a stationary housing mounted in the vicinity of a door, there is a shaped cylinder that is used to acknowledge the alarm and to arm/disarm the door. Light-emitting diodes to indicate the locked/unlocked operating status are also integrated into the housing. In the housing, there are also an acoustical alarm transmitter and an emergency door opening button plus a switch block with positive opening operation. The housing, which is attached to a heavy-duty base that is firmly anchored to the wall, is protected by means of a tamper-protection contact. The emergency door operating button is provided with a shatterproof plastic protective cover to prevent unauthorized actuation.

An authorized person inserts his key into the shaped cylinder lock, whereupon the unlocked operating status is actuated and the door can be opened. After a specified length of time, the emergency door system is automatically returned to the locked operating status. In the event of danger, the protective cover can be destroyed by a strong blow, which simultaneously depresses the emergency door opening button, whereby an acoustical alarm is tripped. An alarm message of this type may be sufficient depending on the specific application.

German Patent No. 196 52 348 C2 also describes a known door system in the housing of which there is an emergency door opening button, visual as well as acoustical display means, an electronic circuit, and a contact unit for access authorization. To make it possible to realize different access systems while retaining the other components, the contact unit for access authorization is realized so that it is modular and replaceable.

Large properties are frequently laid out in a complex fashion and can have a plurality of doors equipped with such door systems. If an alarm is actuated, an acoustical signal does not necessarily provide enough information either for the person summoning assistance or for the service personnel to rapidly and unambiguously locate the corresponding emergency door system.

German Patent No. 195 31 323 A1 describes a known emergency door system that actuates both acoustical and visual alarm transmitters. The emergency door system is located at the operating level near the door, while the alarm transmitters are located above the door and are connected to the emergency door system by means of connecting lines. Although this arrangement is satisfactory with regard to the location of an escape route, the cost and effort required for the installation of the distributed located elements are very high.

OBJECT OF THE INVENTION

One possible object of the present invention may therefore be to improve an emergency door opening system with an emergency door-opening button, in which emergency door system a user-friendly and customer-friendly visual arrangement of the visual display elements may be created, which arrangement can be installed with the emergency door system essentially quickly, easily, and economically. The emergency door system may therefore be designed to be suitable both for surface installation and for flush-mounted installation.

SUMMARY OF THE INVENTION

In at least one possible embodiment, the present invention preferably teaches a display module that can be closed by a cover frame that integrates an integrated protective glass which surrounds the emergency door opening switch. The central location of all the visual display elements in one display module may significantly reduce the cost and effort of installation, because there may be no need to install external visual display elements in the vicinity of the door. Moreover, there may be an essentially compact and therefore economical unit which may be an essentially optimized with regard to the utilization of the available space in the housing of the emergency door system.

A possible additional purpose of integrating the display module into the emergency door system may be to reduce sharp-edged or projecting housing parts, thereby reducing the potential that the unit may cause damage to other parts or injury to users. The location of the display module on the emergency operating button in particular may make it possible for service personnel to take in all the visual displays on the module in a single glance and to determine in a single glance whether the emergency operating button is lit.

In at least one possible embodiment of the present invention, the emergency door opening system may be controlled manually or by a microprocessor or by remote control.

The interchangeability of the display module may reduce the number of replacement parts that have to be kept in a manufacturer's or supplier's inventory and may make it possible to retrofit a basic version with the least possible effort and at the least possible cost. All the wiring in the emergency door system may be realized in the form of standard wiring so that the replacement of a module may not require any special adaptations. The door terminals also may have an essentially uniform appearance.

The corresponding contact unit can be used as a function of the desired display philosophy, whereby the installation of this contact unit may remain identical on all doors. In particular, the time, effort, and expense required for the restructuring measures may be significantly reduced in at least one possible embodiment of the present invention, because in most cases, all that may be necessary may be to replace the contact unit. The housing and the wiring may not be at all involved in this operation, because the individual contact units may be provided with corresponding plug-in connectors which may make it possible to essentially immediately convert or modify a basic system.

In one basic version, the display module can contain the status displays for the shaped cylinder only. These status displays can be realized by means of luminous elements of different colors. This basic version may be suitable for applications in which no visual alarm transmitters are necessary. An additional display module equipped with a visual alarm transmitter may be suitable for applications in which the system or the escape route cannot be localized with sufficient accuracy by an acoustical alarm transmitter.

An essentially optimal alarm transmitter with regard to essential easy recognition and luminous intensity may be a flashing light or strobe light. The output and effectiveness of the light can be essentially optimized in particular by reflectors that may be located in the module or by fiber optics structures.

So that the visual signal can be seen from as many directions as possible, it may further be appropriate to realize the housing of the emergency door system, the cover frame, or the mounting frame of the display module itself with at least some translucent areas or fiber optic structures. In this case it may be possible, for example, to manufacture the cover frame essentially completely from an essentially translucent material or to realize the housing of the emergency door system so that it is partly translucent. Fiber optic structures can also achieve an increased light distribution. One simple variant may be the insertion or attachment of fiber optic structures into and/or on the mounting frame. The light from the display means can be fed into internal and external optical fibers, for example, and distributed by means of the special geometry of the optical fibers, whereby the internal optical fiber distributes the light uniformly over a circular ring-shaped area that is visible from the front, and the external optical fiber distributes the light toward the front and toward the side to essentially guarantee good visibility from all sides. Also conceivable are light sources of different brightness that are illuminated in alternation and display self-explanatory symbols, for example.

The front plate of the display module can also be covered with a luminescent sheet or can even be directly coated with a luminescent material. A projecting arrangement of the display module with respect to the housing of the emergency door system may further increase the visibility of the signal and the distribution of the light if an alarm is given.

The mounting frame of the display module may snap into the system housing with the application of light pressure. The snap connections may be realized so that they are not accessible from outside, so that even when the cover frame is open, it may be essentially impossible to remove the module without destroying it.

The cover frame may comprise a protective glass which must be broken to sound the alarm. The protective glass may be preferred over the variant made of plastic because the potential for injury when the glass shatters may represent a certain barrier that may discourage vandalism or tampering.

The unauthorized opening or removal of the cover frame can be made more difficult or can be indicated by mechanical means and/or by electrical means that trigger a silent alarm in a switching control center or in the display module, so that appropriate measures can be initiated essentially immediately.

A cover frame can be fastened to the mounting frame so that it swings out or opens on hinges, for example. When the cover frame is swung shut, matching catch means on the mounting frame and the cover frame are engaged with one another. The cover frame may also be blocked in position by means of a bar to protect it from tampering. After the emergency door operating button has been actuated, only authorized persons may be able to reset this block. In connection with the locking means, the unauthorized and non-destructive removal of the cover frame may become essentially impossible.

When the locking bar or bolt is deactivated, an unintentional opening of the cover frame may be essentially prevented by the catch means, which may also make possible a correct positioning of the cover frame with respect to the mounting frame. This correct positioning may be necessary for an essentially reliable actuation of an optional tamper-protection contact that may be located on the plate, which can be realized, for example, in the form of a micro-switch or a reed contact. The tamper-protection contact may be actuated by a lug that may be located on the cover frame.

The above-discussed embodiments of the present invention will be described further hereinbelow with reference to the accompanying figures. When the word "invention" is used in this specification, the word "invention" includes "inventions", that is, the plural of "invention". By stating "invention", Applicants do not in any way admit that the present application does not include more than one patentably and non-obviously distinct invention, and maintain that this application may include more than one patentably and non-obviously distinct invention. Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The present invention is explained in greater detail below with reference to a more or less schematically illustrated exemplary embodiment which is illustrated in the accompanying drawings, in which.

DESCRIPTION OF THE PREFERRED EMBODIMENTS

Figure 1:
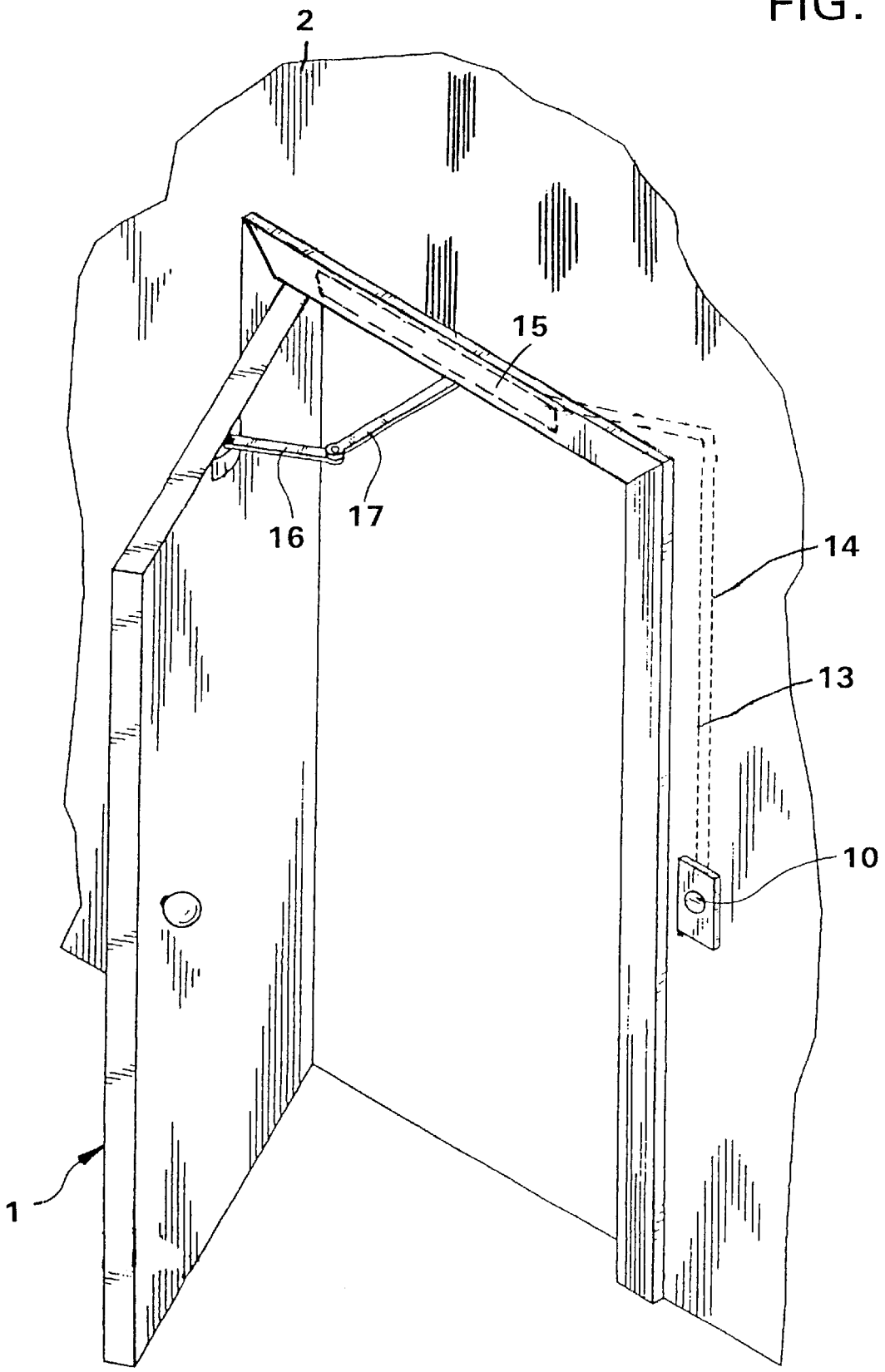
FIG. 1 is a schematic diagram of the placement of the emergency door system on a wall near a door.

FIG. 1 is a schematic diagram of one possible embodiment of the present invention in which the emergency door system 10 (illustrated in more detail in FIGS. 3, 4, and 5) is mounted on a wall 2 near a door 1. The position of the electrical door lock system 10 near the door 1 may make it essentially easy to detect the door 2 once the flashing light 51 (shown in FIG. 3) is activated, for example. In the possible embodiment of the present invention shown in FIG. 1, the emergency door system 10 may be connected to a door opener control unit and hardware system 15 by means of wiring arrangements 13 and 14. Linkage arrangements or actuator arm arrangements 16 and 17 may operate the door 1.

Figure 2:
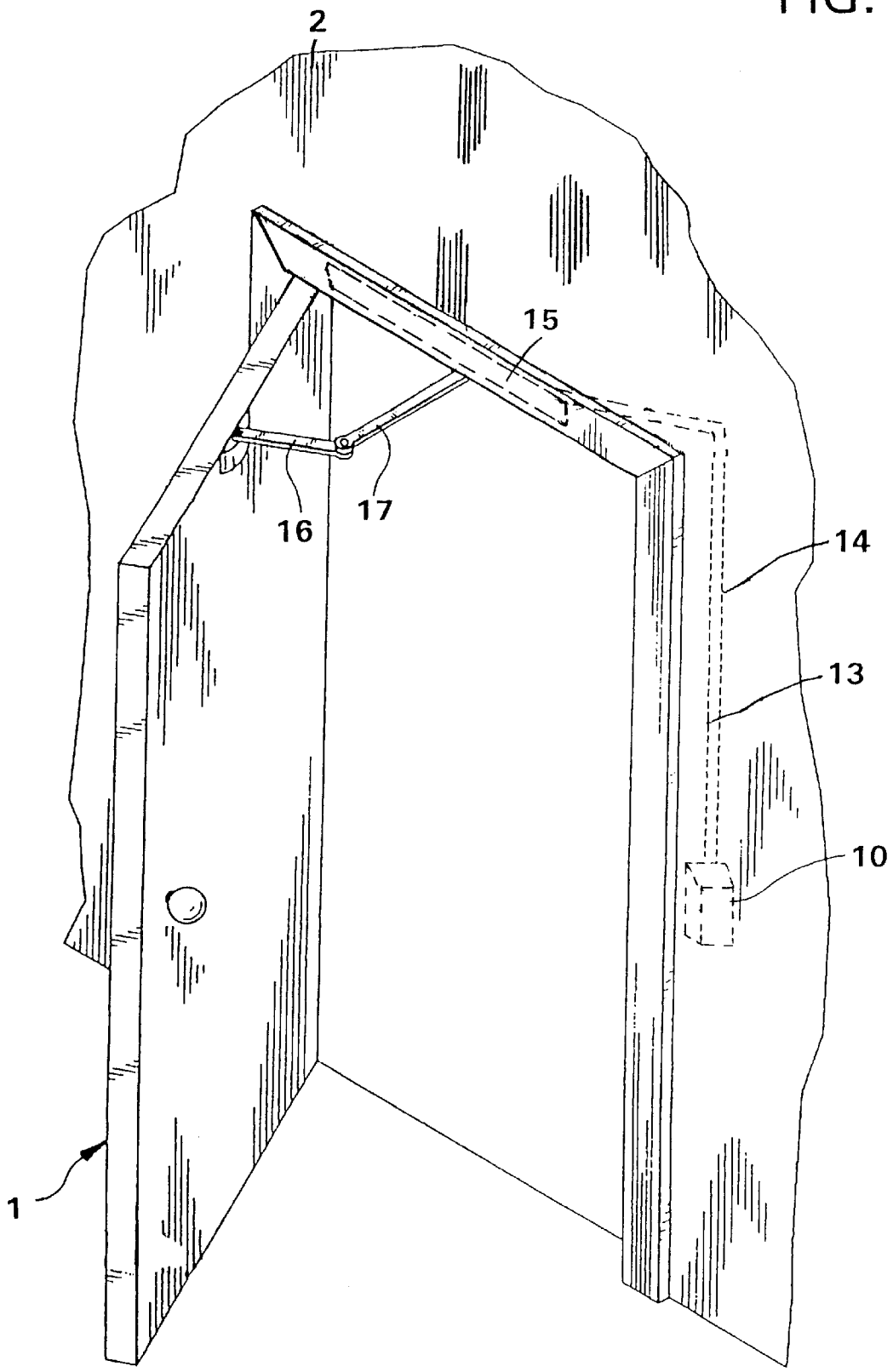
FIG. 2 is a duplicate of FIG. 1 except that the emergency door system is located inside a wall near a door.

FIG. 2 is a duplicate of FIG. 1 except that the emergency door system 10 is located inside the wall 2. The location of the emergency door system 10 inside the wall 2 in this possible embodiment of the present invention may be preferable for use of the emergency door system 10 with emergency exit doors because the emergency door system 10 may be operated more easily from the inside of a building or other structure and may thereby allow essentially easier egress from the building or other structure.

In at least one possible embodiment of the present invention, the door 1 may open or swing inward (that is, toward the interior of a building), open or swing outward (that is, toward the exterior of a building), or open and swing both inward and outward.

Figure 3:
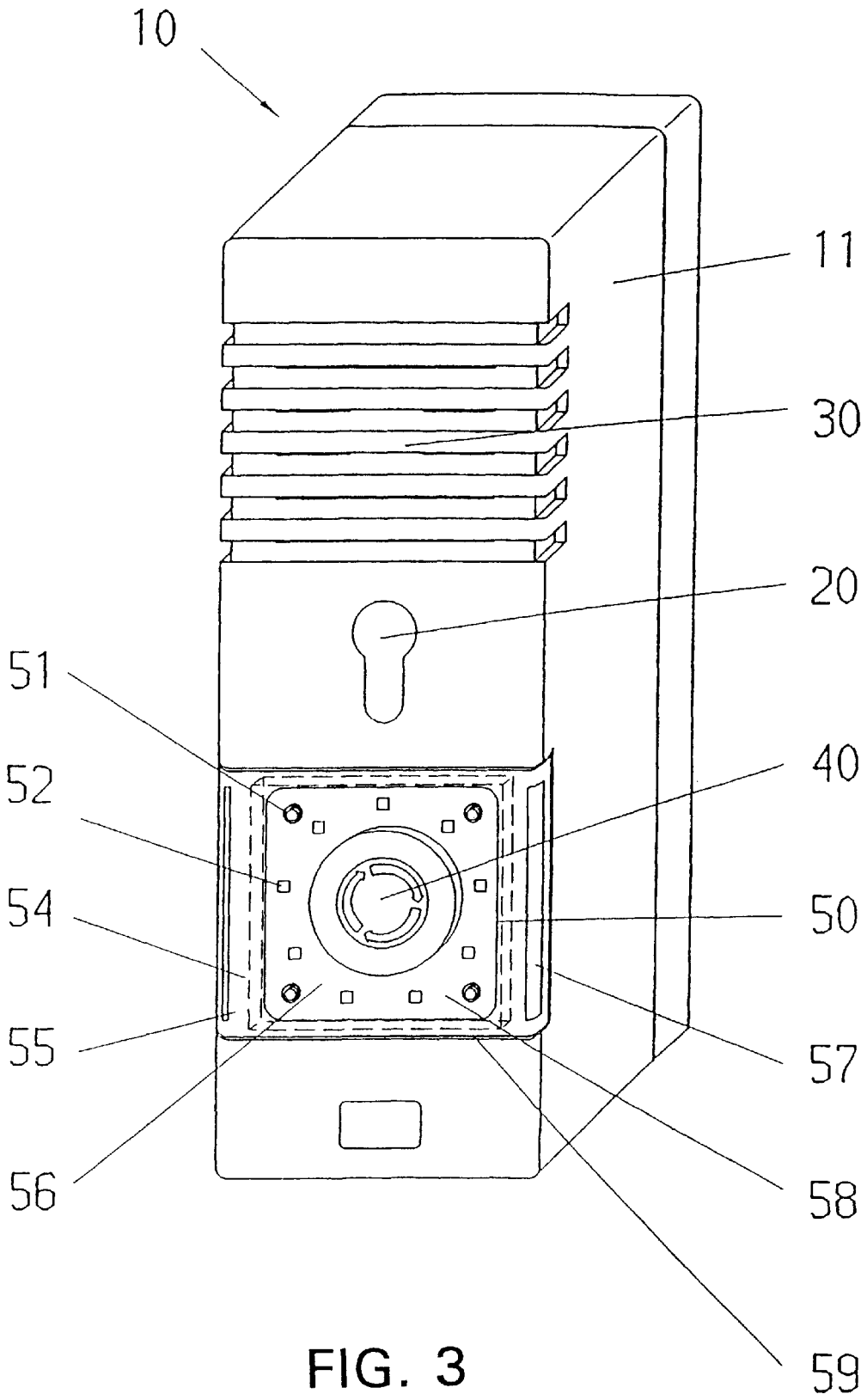
FIG. 3 is a plan view of an emergency door opening system with an extensively equipped display module.
Figure 6:
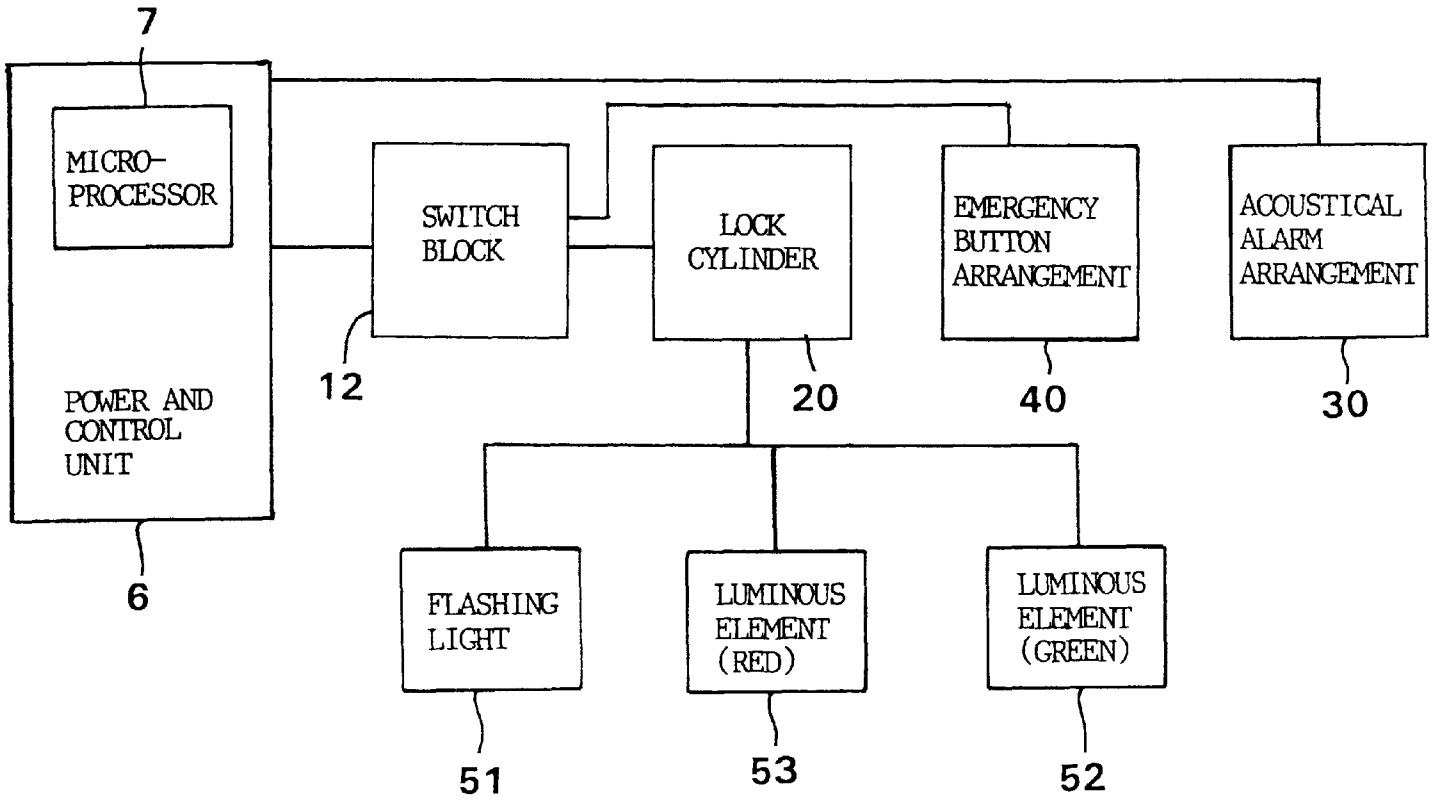
FIG. 6 is a block diagram illustrating connections to a microprocessor-controlled power and control unit for the emergency door system.
Figure 7:
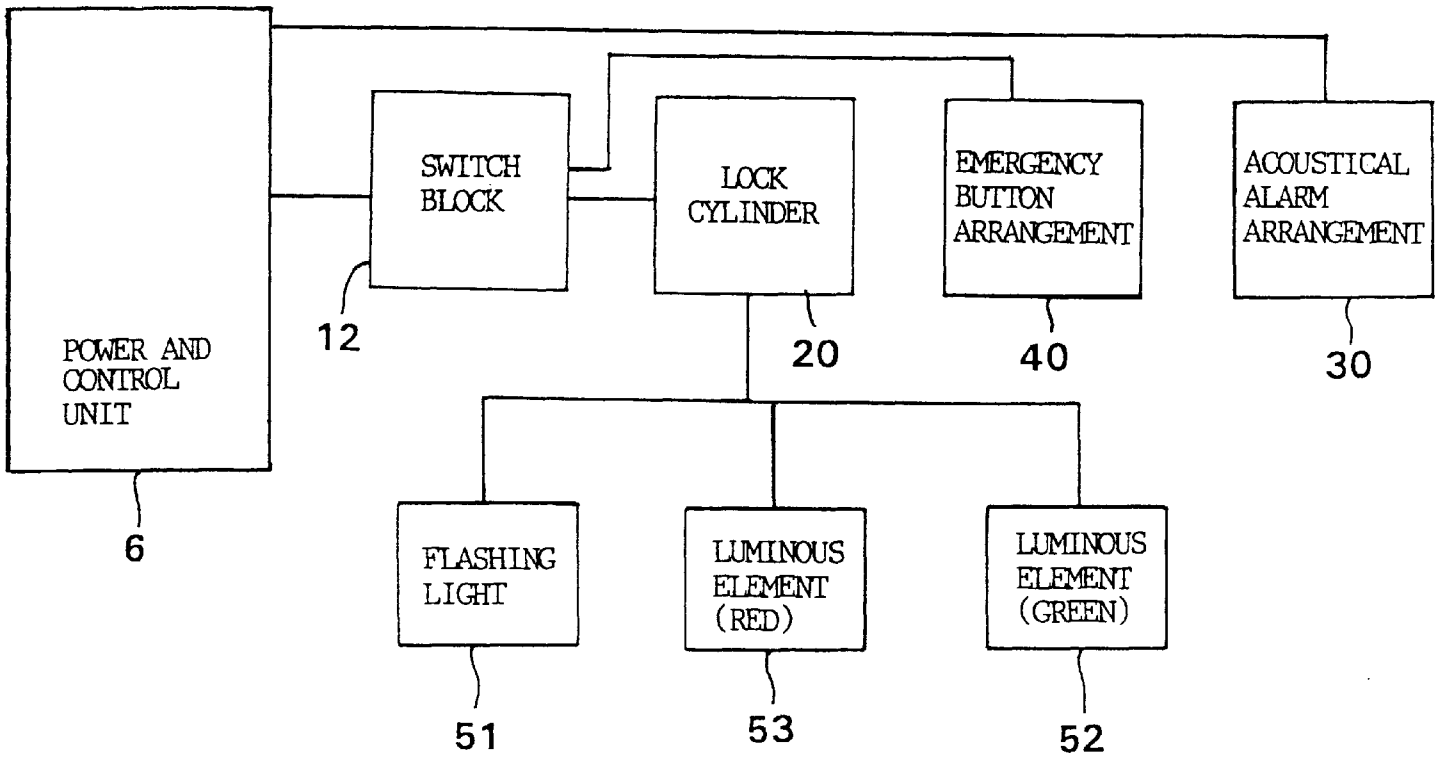
FIG. 7 is a duplicate of FIG. 6 except that the power and control unit in FIG. 7 is manually controlled.
Figure 8:
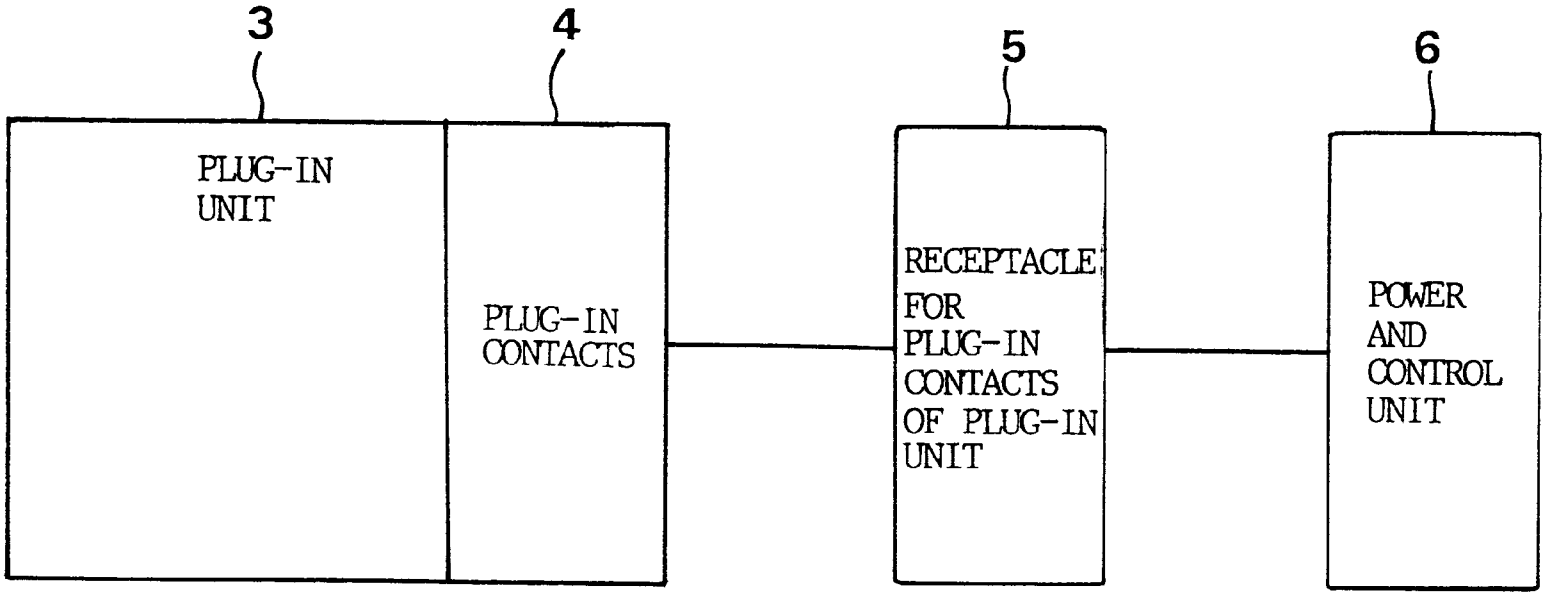
FIG. 8 is a block diagram showing connections between a power and control unit and a plug-in unit for the emergency door system.
Figure 9:
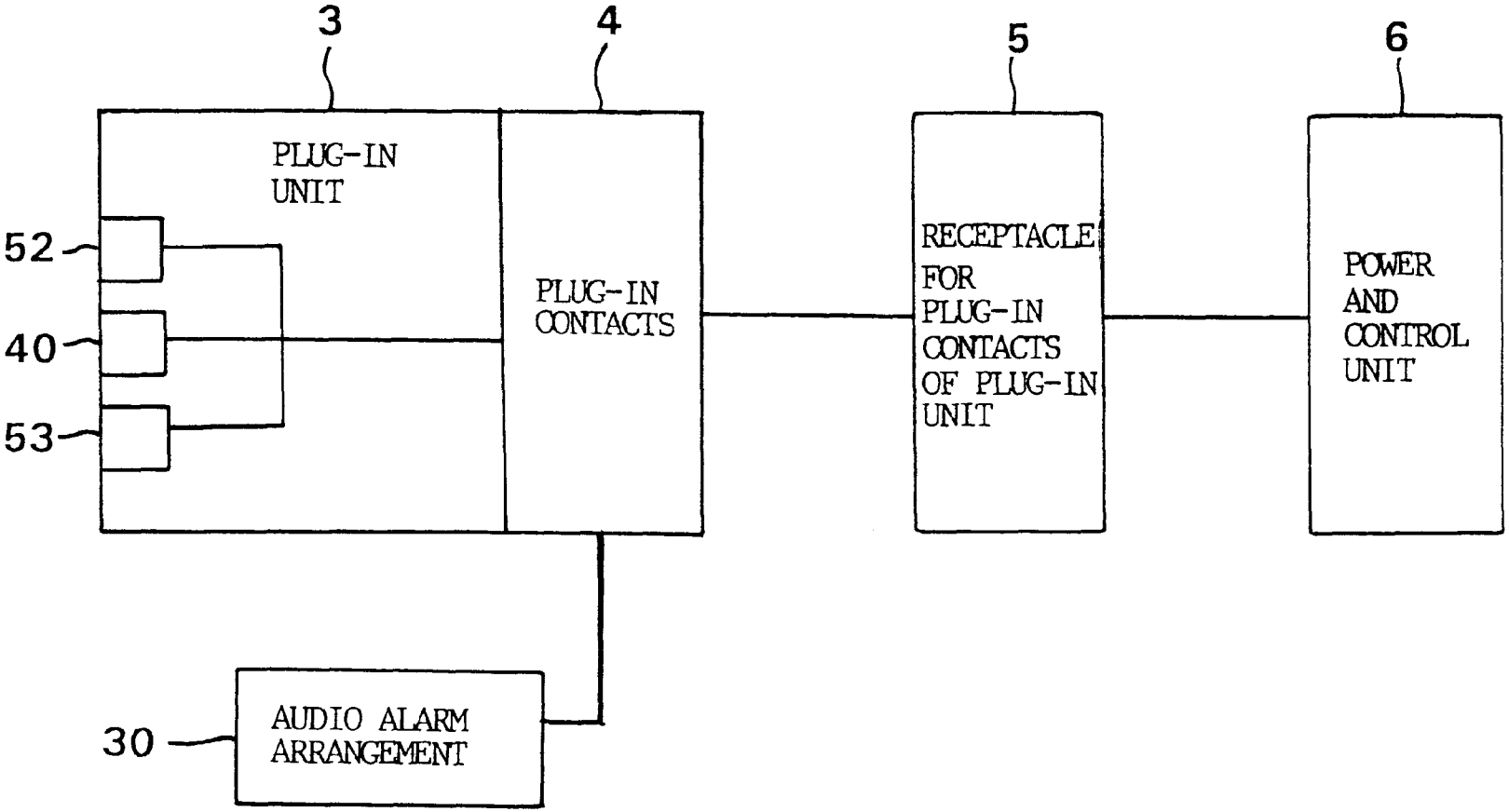
FIG. 9 is a duplicate of FIG. 8 with additional information.

FIG. 3 shows the basic construction of an emergency door opening system 10. In a housing 11 attached in a stationary manner in the vicinity of a door, there is a lock, locking arrangement, keyhole, or shaped cylinder 20 that is used to silence the alarm as well as to arm and disarm it. In the housing 11, there are also an acoustical alarm, acoustical alarm arrangement, or acoustical alarm transmitter 30 and an emergency door operation button 40, along with the positive opening switch block 12, which is not shown in FIG. 3 but is shown in FIGS. 6 and 7. To facilitate the rapid localization of the emergency door system 10, the emergency door operation button 40 is illuminated and the housing 11 is painted green. The housing 11, which is attached to a heavy-duty base that may be positively and non-positively attached to a wall, is protected by means of a tamper-protection contact, plug-in contact unit, or plug-in unit 3, which is not shown in FIG. 3 but is shown in FIGS. 8 and 9. A display module 50 is inserted into the housing 11 of the emergency door system 10 and is connected to the base circuit by means of plug-in connectors or plug-in contacts 4, which are not shown in FIG. 3 but are shown in FIGS. 8 and 9. The display module 50 consists of a rectangular plate or printed circuit board 58, in each corner of which there is a flashing light 51. There are also luminous elements 52, 53 arranged in a circle, e.g., in the form of light-emitting diodes, on the plate 58, whereby green luminous elements 52 indicate the unsecured or unlocked status of the door 1 (shown in FIGS. 1 and 2) and red light-emitting diodes 53 indicate the secured or locked status of the door 1 (shown in FIGS. 1 and 2). A reflector 54 surrounds the plate 58 on the outside. The plate 58 equipped in this manner is located in a mounting frame 59. A cover frame 55 with an integrated protective glass 56 closes the mounting frame 59, so that the result is a complete display module 50.

To install or replace a display module 50, the housing 11 is opened and after the cover frame 55 is opened, the emergency door opening switch 40 is removed so that the module currently installed can be removed. The display module 50 is then installed in the housing 11 together with the emergency door opening button 40. In the center of the plate 58 there may be at least one opening, through which, after installation of the display module 50, the emergency door operating button 40 projects. After the display module 50 has been installed, the plug-in connectors 4, shown in FIGS. 8 and 9, of the plate 58 are plugged into the base circuit and the housing 11 is closed again. The mounting frame 59 is then located in an interlocking manner in the housing 11. The cover frame 55 is fastened to the mounting frame 59 and has translucent areas 57.

When the alarm is to be sounded or triggered, the protective glass 56 is broken and the emergency door operating switch 40 is simultaneously actuated. The signal thus triggers an acoustical alarm on one hand and effects a visual alarm on the other hand. The visual alarm is emitted by means of the flashing lights 51, whereby flashing lights 51 located diagonally opposite one another flash in alternation. The light emitted strikes the reflector 54 and is dispersed to the surrounding area. The light is also dispersed indirectly, i.e., it is emitted via the translucent areas 57 in the cover frame 55. To essentially improve the luminous output, optical fibers can be integrated into the display module 50, although they are not shown here.

Once the protective glass 56 has been destroyed, it can be replaced with a new one, which may be essentially easily inserted into the cover frame 55. The cover frame 55, depending on the specific realization, can be either completely removed or swung out. The unauthorized removal of the cover frame 55 may trigger a silent alarm that may be indicated or located in a control room and/or a corresponding signal in the display module 50 by means of a micro-switch that may be located between the cover frame 55 and the mounting frame 59. If mechanical security means are present between the cover frame 55 and the mounting frame 59 or the housing 11, the cover or cover frame 55 has to be destroyed before it can be removed by unauthorized persons. Authorized personnel can open the cover frame 55 without triggering the signal. The micro-switch may be armed or disarmed by means of an additional key position of the shaped cylinder 20.

The housing 11, which can be designed for surface mounting or flush mounting, may thereby be realized so that all the connections required for the operation of the various display modules 50 are already present and can be replaced or exchanged as necessary by authorized personnel.

Figure 4:
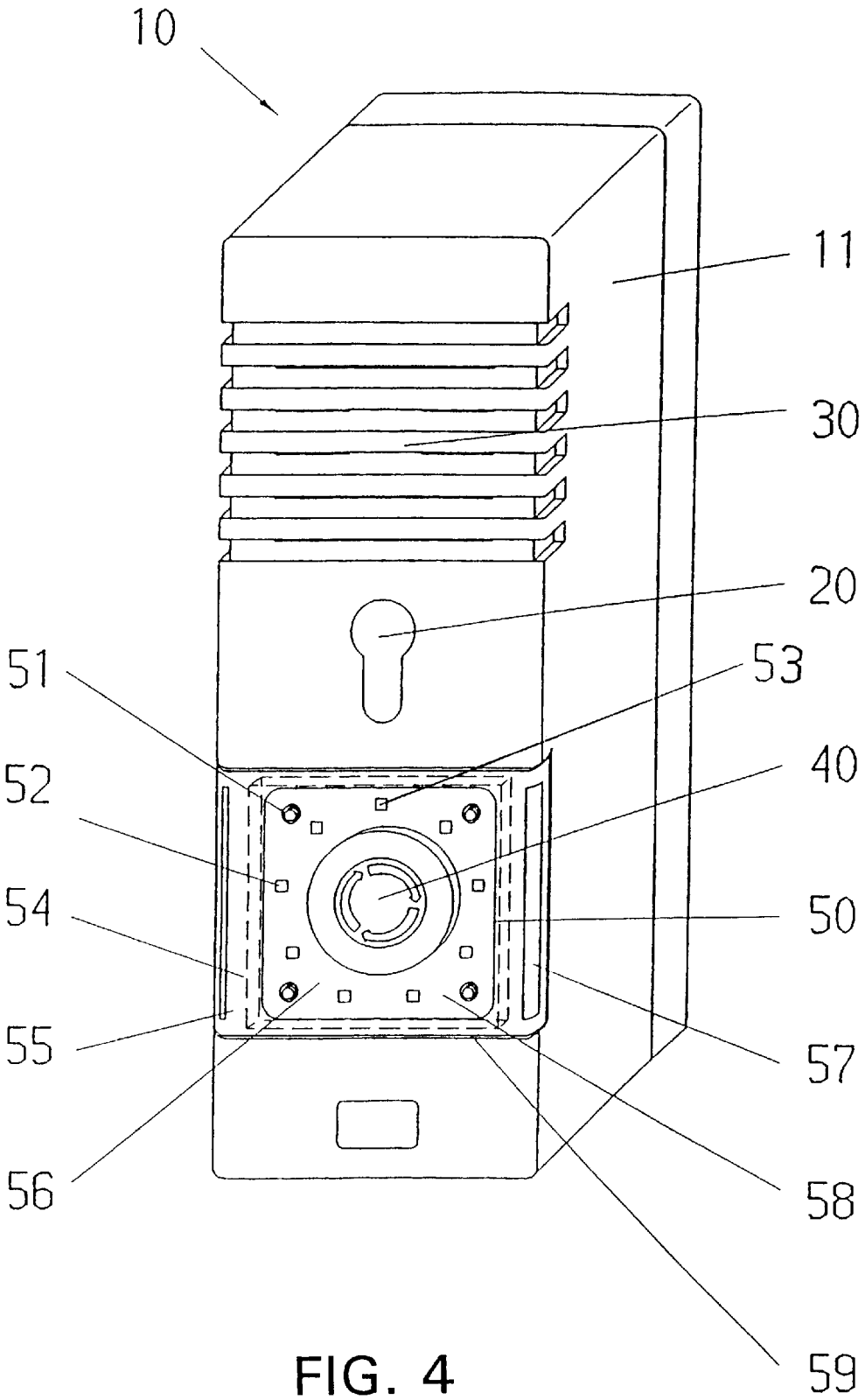
FIG. 4 is a duplicate of FIG. 3 with additional information.

FIG. 4 is a duplicate of FIG. 3 with additional information, specifically, a luminous red element 53 for indicating that the door 1 (shown in FIGS. 1 and 2) is either locked or unlocked.

Figure 5:
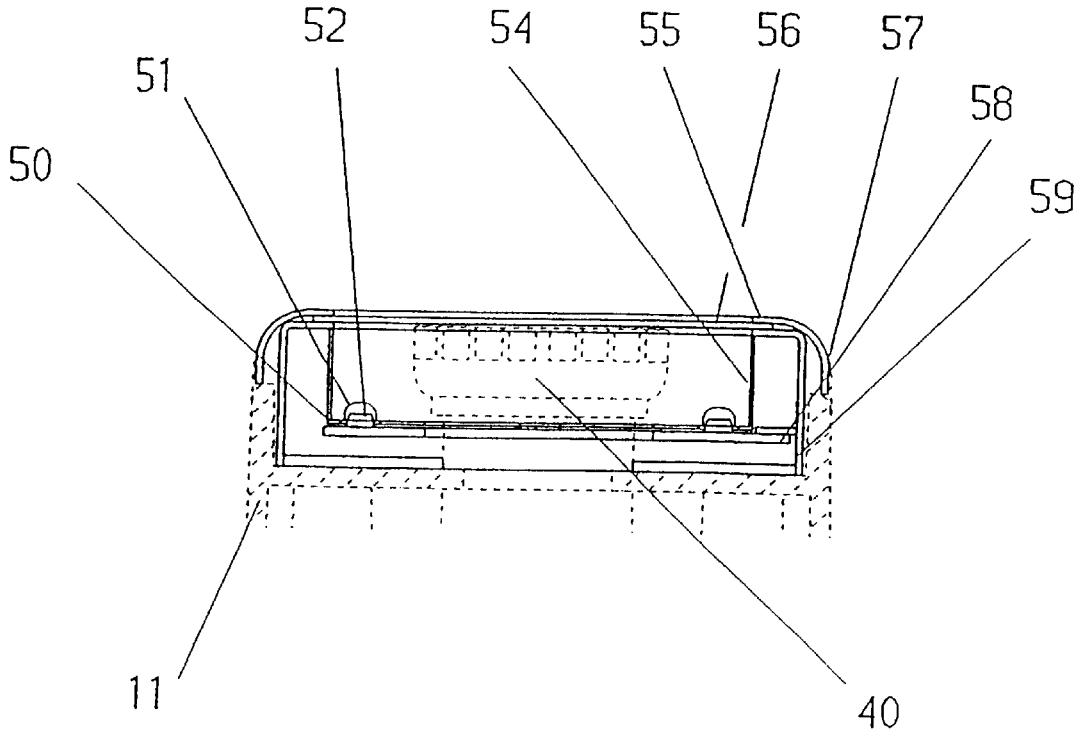
FIG. 5 is a cross-section through the emergency door system at the level of the display module.

FIG. 5 is a cross-section through the emergency door system 10 at the level of the display module 50. FIG. 5 shows the same structures shown in FIG. 3.

FIG. 6 shows connections between a power and control unit 6, which, in at least one possible embodiment of the present invention, may be powered by a microprocessor 7, and other structures associated with the emergency door system 10. Specifically, the power and control unit 6, as controlled by a microprocessor 7, controls the switch block or contact block 12; the lock or shaped cylinder 20, which lock or shaped cylinder 20 in turn controls the visual alarm system or luminous elements 52, 53 and the flashing light 51; the emergency button 40; and the acoustical alarm arrangement 30. FIG. 6 also shows connections between the lock cylinder 20 and the flashing light 51, the red luminous element 53, and the green luminous element 52. In the possible embodiment of the present invention shown in FIG. 6, the position of the lock cylinder 20 controls the operation of the luminous elements 52, 53 and the flashing light 51.

FIG. 6 also shows a connection between the switch block 12 and the lock cylinder 20, as well as a connection between the emergency button arrangement 40 and the switch block 12.

FIG. 7 is a duplicate of FIG. 6 except that FIG. 7 does not show the microprocessor 7. FIG. 7 shows connections between a power and control unit 6, which, in the possible embodiment of the present invention shown in FIG. 7, may be powered manually, and other structures associated with the emergency door system 10. Specifically, the power and control unit 6, as manually controlled, controls the switch block or contact block 12; the lock or shaped cylinder 20, which lock or shaped cylinder 20 in turn controls the visual alarm system or luminous elements 52, 53 and the flashing light 51; the emergency button 40; and the acoustical alarm arrangement 30.

FIG. 8 shows a possible embodiment of the present invention in which the emergency door system comprises a plug-in unit or plug-in contact unit 3, which plugs in essentially easily by means of plug-in contacts 4 to a receptacle 5. FIG. 8 also shows a connection between the power and control unit 6, which may be controlled either manually or by a microprocessor 7 (which microprocessor 7 is shown in FIG. 6), and the receptacle 5, the plug-in contacts 4, and the plug-in unit 3.

FIG. 9 is a duplicate of FIG. 8 with additional information. Specifically, in the possible embodiment of the present invention shown in FIG. 9, luminous elements 52 and 53 and emergency button arrangement 40 are located in the plug-in unit 3 and are connected by means of plug-in contacts 4 to the receptacle 5 and thereby to the power and control unit 6, which power and control unit 6 may be controlled manually or by a microprocessor 7 (which microprocessor 7 is shown in FIG. 6).

One feature of the invention resides broadly in the emergency door system 10 with a housing 11, in which there are: a shaped cylinder 20 with an associated electronic circuit, an emergency door opening button 40 in connection with a switch block to disarm a locking device, and an acoustical alarm 30, characterized by the fact that a display module 50 which can be closed by a cover frame 55 that is equipped with an integrated cover glass 56 surrounds the emergency door opening button 40.

Another feature of the invention resides broadly in the emergency door system 10 characterized by the fact that the display module 50 has a plate 58 located in a mounting frame 59, on which plate 58 there are at least one visual alarm 51 and/or luminous elements 52, 53 that indicate the status of the locking device.

Yet another feature of the invention resides broadly in the emergency door system 10 characterized by the fact that the display module 50 is replaceable or interchangeable, whereby the cover frame 55 is fastened to the mounting frame 59.

Still another feature of the invention resides broadly in the emergency door system 10 characterized by the fact that the visual alarm 51 is a flashing light.

A further feature of the invention resides broadly in the emergency door system 10 characterized by the fact that the visual alarm 51 is surrounded by a reflector 54.

Another feature of the invention resides broadly in the emergency door system 10 characterized by the fact that the light from the visual alarm 51 is fed into a fiber optics structure.

Yet another feature of the invention resides broadly in the emergency door system 10 characterized by the fact that the housing 11, the cover frame 55, and/or the mounting frame 59 are realized at least partly with translucent areas 57 or fiber optics structures.

Still another feature of the invention resides broadly in the emergency door system 10 characterized by the fact that the fiber optics structures or translucent areas 57 are fastened detachably.

A further feature of the invention resides broadly in the emergency door system 10 characterized by the fact that the cover frame 55 can be detached at least over portions of its surface, whereby a signal is emitted in the event of an unauthorized removal of the cover frame 55.

Another feature of the invention resides broadly in the emergency door system 10 characterized by the fact that the display module 50 is located so that it projects with reference to the housing 11 of the emergency door system 10.

Yet another feature of the invention resides broadly in the an improved emergency door system comprising a housing 15 with a shaped cylinder 20, an emergency door opening button 40, and an audio alarm sensor 30. The aim of the invention is to provide an optimized user-friendly and customer-friendly arrangement of optical display elements that can be easily assembled with said emergency door system. This is achieved by surrounding the emergency door opening button 40 with a display module 50 which can be closed by a covering frame 55 that is provided with integrated safety glass 56.

One feature of the invention resides broadly in an improved emergency door with an emergency door opening system with a control box comprising a housing 11 with a shaped cylinder 20, an emergency door opening button 40, and an audio alarm sensor 30 to provide an optimized user-friendly and customer-friendly arrangement of optical display elements that can be easily assembled with the emergency door. This is achieved by surrounding the emergency door opening button 40 with a display module 50 which can be closed by a covering frame 55 that is provided with integrated safety glass 56.

Some examples of alarm and emergency call systems, access control apparatus, key-entry systems, keyless entry systems, pager systems, telephone systems, and other security-related and emergency-related systems, as well as remote management systems related thereto, that possibly may be used or incorporated in at least one possible embodiment of the present invention may be found in the following U.S. Pat. No. 6,041,106, issued to inventors Parsadayan et al. on Mar. 21, 2000; U.S. Pat. No. 6,034,582, issued to inventor Fausch on Mar. 7, 2000; U.S. Pat. No. 6,032,036, issued to inventors Maystre et al. on Feb. 29, 2000; U.S. Pat. No. 5,857,418, issued to inventors Pulec et al. on Jan. 12, 1999; U.S. Pat. No. 5,739,748, issued to inventor Flick on Apr. 14, 1998; U.S. Pat. No. 5,467,076, issued to inventors Ruocco et al. on Nov. 14, 1995; U.S. Pat. No. 5,289,162, issued to inventor McDaniel on Feb. 22, 1994; U.S. Pat. No. 5,233,185, issued to inventor Whitaker on Aug. 3, 1993; U.S. Pat. No. 5,214,293, issued to inventor MacNiel on May 25, 1993; U.S. Pat. No. 4,897,541, issued to inventor Phillips on Jan. 30, 1990; U.S. Pat. No. 4,837,557, issued to inventor Striebel on Jun. 6, 1989; U.S. Pat. No. 4,730,184, issued to inventor Bach on Mar. 8, 1988; U.S. Pat. No. 4,678,905, issued to inventor Phillips on Jul. 7, 1987; U.S. Pat. No. 4,630,035, issued to inventors Stahl et al. on Dec. 16, 1986; U.S. Pat. No. 4,507,654, issued to inventors Stolarczyk et al. on Mar. 26, 1985; U.S. Pat. No. 4,506,254, issued to inventors Right et al. on Mar. 19, 1985; U.S. Pat. No. 4,499,455, issued to inventors Leveille et al. on Feb. 12, 1985; U.S. Pat. No. 4,262,283, issued to inventors Chamberlain et al. on Apr. 14, 1981; U.S. Pat. No. 4,148,019, issued to inventor Durkee on Apr. 3, 1979; and U.S. Pat. No. 3,980,996, issued to inventors Greenspan et al. on Sep. 14, 1976.

Some examples of alarm transmitters, audio alarm systems, visual alarm systems, silent alarm systems, detection systems, and timer systems that possibly may be used or incorporated in at least one possible embodiment of the present invention may be found in the following U.S. Pat. No. 6,032,036, issued to inventors Maystre et al. on Feb. 29, 2000; U.S. Pat. No. 5,739,748, issued to inventor Flick on Apr. 14, 1998; U.S. Pat. No. 5,289,162, issued to inventor McDaniel on Feb. 22, 1994; U.S. Pat. No. 5,253,316, issued to inventors Shibutani et al. on Oct. 12, 1993; U.S. Pat. No. 4,894,643, issued to inventors Thompson et al. on Jan. 16, 1990; U.S. Pat. No. 4,855,713, issued to inventor Brunius on Aug. 8, 1989; U.S. Pat. No. 4,837,557, issued to inventor Striebel on Jun. 6, 1989; U.S. Pat. No. 4,730,184, issued to inventor Bach on Mar. 8, 1988; U.S. Pat. No. 4,649,376, issued to inventor Frank on Mar. 10, 1987; U.S. Pat. No. 4,618,845, issued to inventor Elks on Oct. 21, 1986; U.S. Pat. No. 4,602,357, issued to inventors Yang et al. on Jul. 22, 1986; U.S. Pat. No. 4,507,654, issued to inventors Stolarczyk et al. on Mar. 26, 1985; U.S. Pat. No. 4,506,254, issued to inventors Right et al. on Mar. 19, 1985; U.S. Pat. No. 4,335,375, issued to inventor Schaeffer on Jun. 15, 1982; U.S. Pat. No. 4,499,455, issued to inventors Leveille et al. on Feb. 12, 1985; U.S. Pat. No. 4,482,884, issued to inventors Hauschild et al. on Nov. 13, 1984; U.S. Pat. No. 4,262,283, issued to inventors Chamberlain et al. on Apr. 14, 1981; and U.S. Pat. No. 4,148,019, issued to inventor Durkee on Apr. 3, 1979.

Some examples of contact units or contact blocks that possibly may be used or incorporated in at least one possible embodiment of the present invention may be found in the following U.S. Pat. No. 6,034,582, issued to inventor Fausch on Mar. 7, 2000; U.S. Pat. No. 6,013,884, issued to inventors Rudolph et al. on Jan. 11, 2000; U.S. Pat. No. 5,990,697, issued to inventor Kazama on Nov. 23, 1999; U.S. Pat. No. 5,986,228, issued to inventors Okamoto et al. on Nov. 16, 1999; U.S. Pat. No. 5,983,494, issued to inventor Zimmermann on Nov. 16, 1999; U.S. Pat. No. 5,917,398, issued to inventors Kunz et al. on Jun. 29, 1999; U.S. Pat. No. 5,857,418, issued to inventors Pulec et al. on Jan. 12, 1999; U.S. Pat. No. 5,448,032, issued to inventor Wagatuma on Sep. 5, 1995; U.S. Pat. No. 5,340,331, issued to inventors Bohlen et al. on Aug. 23, 1994; U.S. Pat. No. 5,253,316, issued to inventors Shibutani et al. on Oct. 12, 1993; U.S. Pat. No. 5,231,365, issued to inventor Kato on Jul. 27, 1993; U.S. Pat. No. 5,228,560, issued to inventor Naslund on Jul. 20, 1993; U.S. Pat. No. 5,145,057, issued to inventors Hirota et al. on Sep. 8, 1992; U.S. Pat. No. 5,027,094, issued to inventors Yasuoka et al. on Jun. 25, 1991; U.S. Pat. No. 4,837,557, issued to inventor Striebel on Jun. 6, 1989; U.S. Pat. No. 4,730,184, issued to inventor Bach on Mar. 8, 1988; U.S. Pat. No. 4,728,755, issued to inventors Fowler et al. on Mar. 1, 1988; U.S. Pat. No. 4,620,735, issued to inventor Heydner on Nov. 4, 1986; U.S. Pat. No. 4,618,845, issued to inventor Elks on Oct. 21, 1986; U.S. Pat. No. 4,556,765, issued to inventors Shaw et al. on Dec. 3, 1985; U.S. Pat. No. 4,283,108, issued to inventor Fischer on Aug. 11, 1981; U.S. Pat. No. 4,197,440, issued to inventor Debaigt on Apr. 8, 1980; U.S. Pat. No. 4,153,829, issued to inventor Murata on May 8, 1979; and U.S. Pat. No. 4,032,735, issued to inventor Butterworth on Jun. 28, 1977.

Some examples of plug-in connectors and devices and snap-on connectors and devices that possibly may be used or incorporated in at least one possible embodiment of the present invention may be found in the following U.S. Pat. No. 6,034,582, issued to inventor Fausch on Mar. 7, 2000; U.S. Pat. No. 5,983,494, issued to inventor Zimmermann on Nov. 16, 1999; U.S. Pat. No. 5,340,331, issued to inventors Bohlen et al. on Aug. 23, 1994; U.S. Pat. No. 5,253,316, issued to inventors Shibutani et al. on Oct. 12, 1993; and U.S. Pat. No. 4,649,376, issued to inventor Frank on Mar. 10, 1987.

Some examples of switches, micro-switches, switch blocks or contact blocks, and reed contacts and other contacts that possibly may be used or incorporated in at least one possible embodiment of the present invention may be found in the following U.S. Pat. No. 6,013,884, issued to inventors Rudolph et al. on Jan. 11, 2000; U.S. Pat. No. 5,917,398, issued to inventors Kunz et al. on Jun. 29, 1999; U.S. Pat. No. 5,857,418, issued to inventors Pulec et al. on Jan. 12, 1999; U.S. Pat. No. 5,834,745, issued to inventors Aoki et al. on Nov. 10, 1998; U.S. Pat. No. 5,448,032, issued to inventor Wagatuma on Sep. 5, 1995; U.S. Pat. No. 5,340,331, issued to inventors Bohlen et al. on Aug. 23, 1994; U.S. Pat. No. 5,228,560, issued to inventor Naslund on Jul. 20, 1993; U.S. Pat. No. 4,837,557, issued to inventor Striebel on Jun. 6, 1989; U.S. Pat. No. 4,728,755, issued to inventors Fowler et al. on Mar. 1, 1988; U.S. Pat. No. 4,283,108, issued to inventor Fischer on Aug. 11, 1981; U.S. Pat. No. 4,197,440, issued to inventor Debaigt on Apr. 8, 1980; and U.S. Pat. No. 4,153,829, issued to inventor Murata on May 8, 1979.

Some examples of optical fibers and fiber optics structures that possibly may be used or incorporated in at least one possible embodiment of the present invention may be found in the following U.S. Pat. No. 5,253,316, issued to inventors Shibutani et al. on Oct. 12, 1993; U.S. Pat. No. 5,233,185, issued to inventor Whitaker on Aug. 3, 1993; U.S. Pat. No. 4,897,541, issued to inventor Phillips on Jan. 30, 1990; and U.S. Pat. No. 4,678,905, issued to inventor Phillips on Jul. 7, 1987.

Some examples of reflectors and related structures that possibly may be used or incorporated in at least one possible embodiment of the present invention may be found in the following U.S. Pat. No. 5,420,430, issued to inventor Trett on May 30, 1995; U.S. Pat. No. 5,214,293, issued to inventor MacNiel on May 25, 1993; U.S. Pat. No. 4,649,376, issued to inventor Frank on Mar. 10, 1987; U.S. Pat. No. 4,599,684, issued to inventor Lee on Jul. 8, 1986; and U.S. Pat. No. 4,507,654, issued to inventors Stolarczyk et al. on Mar. 26, 1985.

Some examples of terminals, housings, mountings, and mounting frames that possibly may be used or incorporated in at least one possible embodiment of the present invention may be found in the following U.S. Pat. No. 6,013,884, issued to inventors Rudolph et al. on Jan. 11, 2000; U.S. Pat. No. 5,917,398, issued to inventors Kunz et al. on Jun. 29, 1999; U.S. Pat. No. 5,857,418, issued to inventors Pulec et al. on Jan. 12, 1999; U.S. Pat. No. 5,340,331, issued to inventors Bohlen et al. on Aug. 23, 1994; U.S. Pat. No. 5,253,316, issued to inventors Shibutani et al. on Oct. 12, 1993; U.S. Pat. No. 5,233,185, issued to inventor Whitaker on Aug. 3, 1993; U.S. Pat. No. 5,145,057, issued to inventors Hirota et al. on Sep. 8, 1992; U.S. Pat. No. 4,556,765, issued to inventors Shaw et al. on Dec. 3, 1985; U.S. Pat. No. 4,335,375, issued to inventor Schaeffer on Jun. 15, 1982; and U.S. Pat. No. 4,148,019, issued to inventor Durkee on Apr. 3, 1979.

Some examples of circuit boards, circuit panels, or circuit breakers that possibly may be used or incorporated in at least one possible embodiment of the present invention may be found in the following U.S. Pat. No. 5,986,228, issued to inventors Okamoto et al. on Nov. 16, 1999; U.S. Pat. No. 5,983,494, issued to inventor Zimmermann on Nov. 16, 1999; U.S. Pat. No. 5,231,365, issued to inventor Kato on Jul. 27, 1993; U.S. Pat. No. 4,730,184, issued to inventor Bach on Mar. 8, 1988; and U.S. Pat. No. 4,148,019, issued to inventor Durkee on Apr. 3, 1979.

Some examples of control panels or display panels that possibly be used or incorporated in at least one possible embodiment of the present invention may be found in the following U.S. Pat. No. 5,834,745, issued to inventors Aoki et al. on Nov. 10, 1998; U.S. Pat. No. 5,467,076, issued to inventors Ruocco et al. on Nov. 14, 1995; U.S. Pat. No. 5,212,907, issued to inventor Van Sandt on May 25, 1993; U.S. Pat. No. 4,966,064, issued to inventors Midlang et al. on Oct. 30, 1990; U.S. Pat. No. 4,730,184, issued to inventor Bach on Mar. 8, 1988; U.S. Pat. No. 4,649,376, issued to inventor Frank on Mar. 10, 1987; and U.S. Pat. No. 4,148,019, issued to inventor Durkee on Apr. 3, 1979.

Some examples of sensors, sensor systems, detection systems, infrared emitters and detectors, pressure sensing apparatuses, and/or strain gauges that possibly may be used or incorporated in at least one possible embodiment of the present invention may be found in the following U.S. Pat. No. 5,770,934, issued to inventor Theile on Jun. 23, 1998; U.S. Pat. No. 5,625,266, issued to inventor Stark on Apr. 29, 1997; U.S. Pat. No. 5,467,076, issued to inventors Ruocco et al. on Nov. 14, 1995; U.S. Pat. No. 5,428,278, issued to inventors Bollengier et al. on Jun. 27, 1995; U.S. Pat. No. 5,420,430, issued to inventor Trett on May 30, 1995; U.S. Pat. No. 5,303,593, issued to inventor Kremidas on Apr. 19, 1994; U.S. Pat. No. 5,287,757, issued to inventors Polaert et al. on Feb. 22, 1994; U.S. Pat. No. 5,251,400, issued to inventor Schultze on Oct. 12, 1993; U.S. Pat. No. 5,241,308, issued to inventor Young on Aug. 31, 1993; U.S. Pat. No. 5,233,185, issued to inventor Whitaker on Aug. 3, 1993; U.S. Pat. No. 5,199,519, issued to inventors Polaert et al. on Apr. 6, 1993; U.S. Pat. No. 5,191,798, issued to inventors Tabata et al. on Mar. 9, 1993; U.S. Pat. No. 5,186,060, issued to inventor Marlier on Feb. 16, 1993; U.S. Pat. No. 5,142,152, issued to inventor Boiucaner on Aug. 25, 1992; U.S. Pat. No. 4,897,541, issued to inventor Phillips on Jan. 30, 1990; U.S. Pat. No. 4,894,643, issued to inventors Thompson et al. on Jan. 16, 1990; U.S. Pat. No. 4,815,046, issued to inventor Dorr on Mar. 21, 1989; U.S. Pat. No. 4,779,240, issued to inventor Dorr on Oct. 18, 1988; U.S. Pat. No. 4,678,905, issued to inventor Phillips on Jul. 7, 1987; U.S. Pat. No. 4,618,845, issued to inventor Elks on Oct. 21, 1986; U.S. Pat. No. 4,501,090, issued to inventors Yoshida et al. on Feb. 26, 1985; U.S. Pat. No. 4,430,846, issued to inventors Presley et al. on Feb. 14, 1984; and U.S. Pat. No. 4,148,019, issued to inventor Durkee on Apr. 3, 1979.

Some examples of housing or access panels that possibly may be used or incorporated in at least one possible embodiment of the present invention may be found in U.S. Pat. No. 5,327,682, issued on Jul. 12, 1994.

Some examples of guide rails or systems for door, wall, or partition systems that possibly may be used or incorporated in at least one possible embodiment of the present invention may be found in the following U.S. Pat. No. 5,538,064, issued to inventor Salice on Jul. 23, 1996; U.S. Pat. No. 5,327,681, issued to inventor Minami on Jul. 12, 1994; U.S. Pat. No. 4,759,099, issued to inventors Morano et al. on Jul. 26, 1988; U.S. Pat. No. 4,555,828, issued to inventor Matimura on Dec. 3, 1985; and U.S. Pat. No. 4,084,289, issued to inventor Naimo on Apr. 18, 1978.

Some examples of doors, foldable doors, or door systems and mechanisms and devices for their operation that possibly may be used or incorporated in at least one possible embodiment of the present invention may be found in the following U.S. Pat. No. 5,762,123, issued to inventors Kuyama et al. on Jun. 9, 1998; U.S. Pat. No. 5,651,216, issued to inventor Tillmann on Jul. 29, 1997; U.S. Pat. No. 5,186,230, issued to inventor Ostrander on Feb. 16, 1993; U.S. Pat. No. 5,165,142, issued to inventor Pilsbury on Nov. 24, 1992; U.S. Pat. No. 5,163,494, issued to inventors MacNeil et al. on Nov. 17, 1992; U.S. Pat. No. 5,099,903, issued to inventor Chen on Mar. 31, 1992; U.S. Pat. No. 5,070,926, issued to inventor Behring on Dec. 10, 1991; and U.S. Pat. No. 4,932,455, issued to inventor Yamada on Jun. 12, 1990.

Some examples of movable partition or wall systems and devices for their operation that possibly may be used or incorporated in at least one possible embodiment of the present invention may be found in the following U.S. Pat. No. 5,730,027, issued to inventor Hormann on Mar. 24, 1998; U.S. Pat. No. 5,461,829, issued to inventors Lehto et al. on Oct. 31, 1995; U.S. Pat. No. 5,404,675, issued to inventor Schmidhauser on Apr. 11, 1995; U.S. Pat. No. 5,329,857, issued to inventor Owens on Jul. 19, 1994; U.S. Pat. No. 5,295,281, issued to inventor Kordes on Mar. 22, 1994; U.S. Pat. No. 5,394,648, issued to inventor Kordes on Mar. 7, 1995; U.S. Pat. No. 5,417,013, issued to inventor Tillmann on May 23, 1995; U.S. Pat. No. 5,544,462, issued to inventor Kordes on Aug. 13, 1996; U.S. Pat. No. 5,406,761, issued to inventors Hobbiebrunken et al. on Apr. 18, 1995; U.S. Pat. No. 5,152,332, issued to inventor Siener on Oct. 6, 1992; U.S. Pat. No. 5,042,555, issued to inventor Owens on Aug. 27, 1991; U.S. Pat. No. 4,934,119, issued to inventor Ybarra on Jun. 19, 1990; U.S. Pat. No. 4,914,878, issued to inventors Tamaki et al. on Apr. 10, 1990; U.S. Pat. No. 4,895,246, issued to inventor Rizzi on Jan. 23, 1990; U.S. Pat. No. 4,752,987, issued to inventors Dreyer et al. on Jun. 28, 1988; U.S. Pat. No. 4,596,094, issued to inventors Teller et al. on Jun. 24, 1986; U.S. Pat. No. 4,555,828, issued to inventor Matimura on Dec. 3, 1985; U.S. Pat. No. 4,458,462, issued to inventor Schold on Jul. 10, 1984; U.S. Pat. No. 4,404,770, issued to inventor Markus on Sep. 20, 1983; and U.S. Pat. No. 4,112,647, issued to inventor Scheid on Sep. 12, 1978.

Some examples of drives or electromechanical or electrohydraulic drives that possibly may be used or incorporated in at least one possible embodiment of the present invention may be found in the following U.S. Pat. No. 5,666,268, issued to inventors Rix et al. on Sep. 9, 1997; U.S. Pat. No. 5,386,885, issued to inventors Bunzl et al. on Feb. 7, 1995; U.S. Pat. No. 5,521,400, issued to inventor Schultze on Oct. 12, 1993; U.S. Pat. No. 5,080,635, issued to inventors Martinez et al. on Jan. 14, 1992; U.S. Pat. No. 4,501,090, issued to inventors Yoshida et al. on Feb. 26, 1985; and U.S. Pat. No. 4,430,846, issued to inventors Presley et al. on Feb. 14, 1984.

Some examples of electronic control or electronic regulation systems that possibly may be used or incorporated in at least one possible embodiment of the present invention may be found in the following U.S. Pat. No. 5,770,934, issued to inventor Theile on Jun. 23, 1998; U.S. Pat. No. 5,666,268, issued to inventors Rix et al. on Sep. 9, 1997; U.S. Pat. No. 5,625,266, issued to inventor Stark on Apr. 29, 1997; U.S. Pat. No. 5,428,278, issued to inventors Bollengier et al. on Jun. 27, 1995; U.S. Pat. No. 4,838,052, issued to inventors Williams et al. on Jun. 13, 1989; and U.S. Pat. No. 4,197,440, issued to inventor Debaigt on Apr. 8, 1980.

Some examples of control systems which measure operating parameters and learn therefrom that possibly may be used or incorporated in at least one possible embodiment of the present invention may be found in the following U.S. Pat. No. 5,770,934, issued to inventor Theile on Jun. 23, 1998; U.S. Pat. No. 5,191,272, issued to inventors Torii et al. on Mar. 2, 1993; U.S. Pat. No. 5,223,820, issued to inventors Sutterlin et al. on Jun. 29, 1993; U.S. Pat. No. 4,855,713, issued to inventor Brunius on Aug. 8, 1989; and U.S. Pat. No. 4,655,188, issued to inventors Tomisawa et al. on Apr. 7, 1987.

Some examples of memories that possibly may be used or incorporated in at least one possible embodiment of the present invention may be found in the following U.S. Pat. No. 5,789,887, issued to inventor Elischewski on Aug. 4, 1998; U.S. Pat. No. 5,770,934, issued to inventor Theile on Jun. 23, 1998; U.S. Pat. No. 5,453,736, issued to inventor Noren on Sep. 26, 1995; U.S. Pat. No. 5,315,220, issued to inventors Takimoto et al. on May 24, 1994; U.S. Pat. No. 4,994,724, issued to inventor Hsu on Feb. 19, 1991; U.S. Pat. No. 4,498,033, issued to inventors Aihara et al. on Feb. 5, 1985; and U.S. Pat. No. 4,328,540, issued to inventors Matsuoka et al. on May 4, 1982.

Some examples of microprocessors that possibly may be used or incorporated in at least one possible embodiment of the present invention may be found in the following U.S. Pat. No. 5,770,934, issued to inventor Theile on Jun. 23, 1998; U.S. Pat. No. 5,653,056, issued to inventor Stark on Aug. 5, 1997; U.S. Pat. No. 5,647,173, issued to inventors Stark et al. on. Jul. 15, 1997; U.S. Pat. No. 5,625,266, issued to inventor Stark on Apr. 29, 1997; U.S. Pat. No. 5,479,151, issued to inventors Lavelle et al. on Dec. 26, 1995; U.S. Pat. No. 5,453,736, issued to inventor Noren on Sep. 26, 1995; U.S. Pat. No. 5,437,174, issued to inventor Aydin on Aug. 1, 1995; U.S. Pat. No. 5,274,312, issued to inventor Gerstenkorn on Dec. 28, 1993; U.S. Pat. No. 5,230,179, issued to inventors Richmond et al. on Jul. 27, 1993; U.S. Pat. No. 5,142,152, issued to inventor Boiucaner on Aug. 25, 1992; U.S. Pat. No. 5,140,173, issued to inventors Chau et al. on Aug. 18, 1992; U.S. Pat. No. 5,136,809, issued to inventors Richmond et al. on Aug. 11, 1992; U.S. Pat. No. 5,132,503, issued to inventor Lee on Jul. 21, 1992; U.S. Pat. No. 4,980,618, issued to inventors Milnes et al. on Dec. 25, 1990; U.S. Pat. No. 4,831,509, issued to inventors Jones et al. on May 16, 1989; U.S. Pat. No. 4,815,046, issued to inventor Dorr on Mar. 21, 1989; U.S. Pat. No. 4,779,240, issued to inventor Dorr on Oct. 18, 1988; and U.S. Pat. No. 4,262,283, issued to inventors Chamberlain et al. on Apr. 14, 1981.

Some examples of open-loop control systems that possibly may be used or incorporated in at least one possible embodiment of the present invention may be found in the following U.S. Pat. No. 5,770,934, issued to inventor Theile on Jun. 23, 1998; U.S. Pat. No. 5,210,473, issued to inventor Backstrand on May 11, 1993; U.S. Pat. No. 5,320,186, issued to inventors Strosser et al. on Jun. 14, 1994; No. 5,369,342, issued to inventors Rudzewicz et al. on Nov. 29, 1994; and U.S. Pat. No. 4,148,019, issued to inventor Durkee on Apr. 3, 1979.

Some examples of closed-loop control circuits that possibly may be used or incorporated in at least one possible embodiment of the present invention may be found in the following U.S. Pat. No. 5,770,934, issued to inventor Theile on Jun. 23, 1998; U.S. Pat. No. 5,189,605, issued to inventors Zuehlke et al. on Feb. 23, 1993; U.S. Pat. No. 5,223,072, issued to inventors Brockman et al. on Jun. 29, 1993; U.S. Pat. No. 5,252,901, issued to inventors Ozawa et al. on Oct. 12, 1993; and U.S. Pat. No. 4,148,019, issued to inventor Durkee on Apr. 3, 1979.

Some examples of look up tables accessed by computers or microprocessors that possibly may be used or incorporated in at least one possible embodiment of the present invention may be found in the following U.S. Pat. No. 5,284,116, issued to inventor Richeson, Jr. on Feb. 8, 1994; U.S. Pat. No. 5,359,325, issued to inventors Ford et al. on Oct. 25, 1994; and U.S. Pat. No. 5,371,537, issued to inventors Bohan et al. on Dec. 6, 1994.

Some examples of databuses or databus systems that possibly may be used or incorporated in at least one possible embodiment of the present invention may be found in the following U.S. Pat. No. 6,008,546, issued to inventor Sage on Dec. 28, 1999; U.S. Pat. No. 5,978,193, issued to inventor Kaaden on Nov. 2, 1999; U.S. Pat. No. 5,815,732, issued to inventors Cooper et al. on Sep. 29, 1998; U.S. Pat. No. 5,507,001, issued to inventor Nishizawa on Apr. 9, 1996; U.S. Pat. No. 5,402,423, issued to inventors van Kersen on Mar. 28, 1995; U.S. Pat. No. 4,725,838, issued to inventors Maschek et al. on Feb. 16, 1998; U.S. Pat. No. 4,720,155, issued to inventors Schildkraut et al. on Jan. 19, 1988; and U.S. Pat. No. 4,488,066, issued to inventor Shoji on Dec. 11, 1984.

Some examples of guides, rollers, guide elements, or guide arrangements that possibly may be used or incorporated in at least one possible embodiment of the present invention may be found in the following U.S. Pat. No. 5,634,297, issued to inventor Ito on Jun. 3, 1997; U.S. Pat. No. 5,461,829, issued to inventors Lehto et al. on Oct. 31, 1995; U.S. Pat. No. 5,349,783, issued to inventors Jasperson et al. on Sep. 27, 1994; U.S. Pat. No. 5,263,280, issued to inventor Dilcher on Nov. 23, 1993; U.S. Pat. No. 5,203,116, issued to inventor Chen on Apr. 20, 1993; U.S. Pat. No. 5,063,710, issued to inventor Schap on Nov. 12, 1991; U.S. Pat. No. 5,039,143, issued to inventor Ramsauer on Aug. 13, 1991; U.S. Pat. No. 5,031,271, issued to inventor Baus on Jul. 16, 1991; U.S. Pat. No. 4,991,257, issued to inventor Eutebach on Feb. 12, 1991; U.S. Pat. No. 4,938,273, issued to inventors Dubbelman et al. on Jul. 3, 1990; U.S. Pat. No. 4,912,807, issued to inventors Futch et al. on Apr. 3, 1990; U.S. Pat. No. 4,924,625, issued to inventor Dilcher on May 15, 1990; U.S. Pat. No. 4,836,263, issued to inventor Ament on Jun. 6, 1989; U.S. Pat. No. 4,802,707, issued to inventor Schlapp on Feb. 7, 1989; U.S. Pat. No. 4,773,465, issued to inventor Hamacher on Sep. 27, 1988; U.S. Pat. No. 4,707,022,; issued to inventors Roos et al. on Nov. 17, 1987; U.S. Pat. No. 4,702,514, issued to inventor Perry on Oct. 27, 1987; U.S. Pat. No. 4,680,828, issued to inventors Cook et al. on Jul. 21, 1987; U.S. Pat. No. 4,672,712, issued to inventor Stevenson on Jun. 16, 1987; U.S. Pat. No. 4,668,008, issued to inventor Stinson on May 26, 1987; U.S. Pat. No. 4,577,577, issued to inventor Eriksson on Mar. 25, 1986; U.S. Pat. No. 4,565,031, issued to inventor Sakamoto on Jan. 21, 1986; U.S. Pat. No. 4,503,637, issued to inventor Parente on Mar. 12, 1985; U.S. Pat. No. 4,455,709, issued to inventor Zanini on Jun. 26, 1984; U.S. Pat. No. 4,398,373, issued to inventor Mancuso on Aug. 16, 1983; U.S. Pat. No. 4,358,863, issued to inventor Jacobsen on Nov. 16, 1982; U.S. Pat. No. 4,281,435, issued to inventors Winter et al. on Aug. 4, 1981; U.S. Pat. No. 4,228,560, issued to inventor Baus on Oct. 21, 1980; U.S. Pat. No. 4,183,179, issued to inventors Gutridge et al. on Jan. 15, 1980; U.S. Pat. No. 4,176,497, issued to inventor Nagy on Dec. 4, 1979; U.S. Pat. No. 4,176,496, issued to inventors Rock et al. on Dec. 4, 1979; U.S. Pat. No. 4,064,593, issued to inventor Helmick on Dec. 27, 1977; and U.S. Pat. No. 4,063,388, issued to inventor Little on Dec. 20, 1977.

Some examples of turnouts or turnout switches that possibly may be used or incorporated in at least one possible embodiment of the present invention may be found in the following U.S. Pat. No. 5,577,691, issued to inventors Erich et al. on Nov. 26, 1996; U.S. Pat. No. 5,375,797, issued to inventor Willow on Dec. 27, 1994; U.S. Pat. No. 4,970,964, issued to inventors Burg et al. on Nov. 20, 1990; U.S. Pat. No. 4,970,962, issued to inventors Burg et al. on Nov. 20, 1990; U.S. Pat. No. 4,890,804, issued to inventors Teramoto et al. on Jan. 2, 1990; and U.S. Pat. No. 4,005,839, issued to inventor Frank on Feb. 1, 1977.

Some examples of linkages or actuator arms that possibly may be used or incorporated in at least one possible embodiment of the present invention may be found in the following U.S. Pat. No. 5,417,013, issued to inventor Tillmann on May 23, 1995; U.S. Pat. No. 5,163,494, issued to inventors MacNeil et al. on Nov. 17, 1992; U.S. Pat. No. 5,149,180, issued to inventors Haab et al. on Sep. 22, 1992; U.S. Pat. No. 5,121,976, issued to inventors Haab et al. on Jun. 16, 1992; U.S. Pat. No. 5,058,238, issued to inventor Lautenschlager on Oct. 22, 1991; U.S. Pat. No. 4,821,375, issued to inventor Kozon on Apr. 18, 1989; U.S. Pat. No. 4,759,099, issued to inventors Morano et al. on Jul. 26, 1988; U.S. Pat. No. 4,669,147, issued to inventor Suchanek on Jun. 2, 1987; U.S. Pat. No. 4,419,787, issued to inventor Lieberman on Dec. 13, 1983; U.S. Pat. No. 4,285,094, issued to inventor Levings, Jr. on Aug. 25, 1981; U.S. Pat. No. 4,184,382, issued to inventor Redman on Jan. 22, 1980; and U.S. Pat. No. 4,080,687, issued to inventor Jentsch on Mar. 28, 1978.

Some examples of door closers that possibly may be used or incorporated in at least one possible embodiment of the present invention may be found in the following U.S. Pat. No. 5,832,561, issued to inventor Bienek on Nov. 10, 1998; U.S. Pat. No. 5,802,670, issued to inventor Bienek on Sep. 8, 1998; U.S. Pat. No. 5,770,934, issued to inventor Theile on Jun. 23, 1998; U.S. Pat. No. 5,651,216, issued to inventor Tillmann on Jul. 29, 1997; U.S. Pat. No. 5,428,278, issued to inventors Bollengier et al. on Jun. 27, 1995; U.S. Pat. No. 5,417,013, issued to inventor Tillmann on May 23, 1995; U.S. Pat. No. 5,251,400, issued to inventor Schultze on Oct. 12, 1993; U.S. Pat. No. 4,669,147, issued to inventor Suchanek on Jun. 2, 1987; U.S. Pat. No. 4,501,090, issued to inventors Yoshida et al. on Feb. 26, 1985; U.S. Pat. No. 4,419,787, issued to inventor Lieberman on Dec. 13, 1983; and U.S. Pat. No. 4,285,094, issued to inventor Levings, Jr. on Aug. 25, 1981.

Some further examples of door closers that possibly may be used or incorporated in at least one possible embodiment of the present invention may be found in the advertising brochure entitled "Das Programm" for the company DORMA GmbH+Co. KG, Postfach 4009, D-58247 Ennepetal, Federal Republic of Germany, which advertising brochure bears the following identifying information: WN 051307, 12/96, Programm, D, 10, STB, 2/97, Atelier G. Heinz, Velbert, which advertising brochure describes, for example, on page 25, the door closer or drive system named the "DORMA ED 200".

Some examples of devices or transmissions that possibly may be used or incorporated in at least one possible embodiment of the present invention may be found in U.S. Pat. No. 4,763,385, issued to inventors Furch et al. on Aug. 16, 1988, and U.S. Pat. No. 4,744,125, issued to inventors Scheck et al. on May 17, 1988.

The components disclosed in the various publications, disclosed or incorporated by reference herein, may be used in the embodiments of the present invention, as well as equivalents thereof.

The appended drawings in their entirety, including all dimensions, proportions and/or shapes in at least one embodiment of the present invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The following patents, patent applications, or patent publications, which were cited in the International Search Report dated Dec. 1, 1999, which International Search Report was mailed to Applicants on Dec. 10, 1999, are hereby incorporated by reference as if set forth in their entirety herein: German Patent Publication DE-OS 196 52 348 A 1, laid open on Jun. 25, 1998, having inventors Armin Heese, Manfred Kampmann, Axel Schmidt, and Wim Coppens, and having assignee DORMA GmbH & Co. KG, 58256 Ennepetal, Federal Republic of Germany; German Patent Publication DE-OS 23 14 567, laid open on Oct. 3, 1974, having the inventors Herbert Krautwald, Rudolf Klotzbach, and Philipp Metzger, and having assignee Siemens AG, 1000 Berlin and 1000 Munich, Federal Republic of Germany; DATABASE WPI, Section EI, Week 199729, Derwent Publications Ltd., London, GB, Class WOS, AN 1997-311599, XP002124478; German Patent Publication DE-OS 195 45 274 A1, laid open on Apr. 18, 1996; European Patent Publication EP-OS 0 592 926 A1, laid open on Apr. 20, 1994, having inventors Werner Keller, Dino Bettini, and Gerhard Sobotzki, and having assignee Siemens Aktiengesellschaft, Wittelsbacherplatz 2, D-80333 Munich, Federal Republic of Germany; and German Patent DE 86 07 155.6, issued on Apr. 28, 1988, having owner Alois Zettler Elektrotechnische Fabrik GmbH, 8000 Munich, Federal Republic of Germany.

The corresponding foreign and international patent publication applications, namely, Federal Republic of Germany Patent Application No. DE 198 34 013.3, filed on Jul. 28, 1998, having inventors Manfred Kampmann, Axel Schmidt and Armin Heese, and DE-OS 198 34 013.3 and DE-PS 198 34 013.3 and International Application No. PCT/EP99/05388, filed on Jul. 27, 1999, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

U.S. patent application Ser. No. 09/378,161, filed Aug. 19, 1999, entitled "Pivot Hung Door Drive", having the inventor Oliver Moll, and having assignee DORMA GmbH+Co. KG, as well as its corresponding foreign and international patent publications and patent applications, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at Applicants' option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. An emergency door with an emergency door opening system, said emergency door opening system comprising:

a control box to control said emergency door opening system;

said control box comprising a housing;

a cylinder lock with an associated electronic circuit;

an emergency door opening button arrangement in connection with a switch block to disarm a locking device;

an acoustical alarm arrangement;

a display module comprising a cover frame for closing and protecting said display module;

said cover frame comprising an integrated cover glass; and said display module comprises a replaceable unit that may be removed in one piece from said control box to permit the insertion of a different replaceable unit into said display module, which different replaceable unit is configured to alter the function of said display module.

2. The emergency door opening system according to claim 1, wherein:

said display module comprises a plate located in a mounting frame for mounting said display module on said control box;

said plate comprises at least one of (a) and (b), where (a) and (b) are the following:

(a) at least one visual alarm arrangement being configured to indicate the status of said cylinder lock; and (b) at least one luminous element being configured to indicate the status of said cylinder lock.

3. The emergency door opening system according to claim 2, wherein:

said cover frame is configured to be fastened to said mounting frame.

4. The emergency door opening system according to claim 3, wherein said visual alarm arrangement is a flashing light.

5. The emergency door opening system according to claim 4, wherein a reflector is generally disposed about said visual alarm arrangement.

6. The emergency door opening system according to claim 5, wherein:

said emergency door opening system further comprises a fiber optics structure; and light from said visual alarm arrangement is directed into said fiber optics structure.

7. The emergency door opening system according to claim 5, wherein:

at least one of (a), (b), and (c) at least partly comprise substantially translucent areas, where (a), (b), and (c) are the following:

(a) said housing;

(b) said cover frame; and (c) said mounting frame; and said substantially translucent areas are fastened detachably.

8. The emergency door opening system according to claim 5, wherein:

at least one of (a), (b), and (c) at least partly comprises a plurality of fiber optics structures, where (a), (b), and (c) are the following:

(a) said housing;

(b) said cover frame; and (c) said mounting frame; and said plurality of fiber optics structures are fastened detachably.

9. The emergency door opening system according to claim 7, wherein:

said cover frame is at least partly detachable; and said emergency door opening system emits a signal upon an unauthorized removal of said cover frame.

10. The emergency door opening system according to claim 9, wherein:

said cover frame is at least partly detachable; and said door system emits a signal upon an unauthorized removal of said cover frame.

11. An emergency door-with an emergency door opening system, said emergency door opening system comprising:

a control box;

a housing;.

a cylinder lock with an associated electronic circuit;

an emergency door opening button arrangement in connection with a switch block to disarm a locking device; and an acoustical alarm;

wherein a display module which can be closed by a cover frame that is equipped with an integrated cover glass surrounds said emergency door opening button; and said display module being configured to be replaceable and interchangeable, wherein said display module is configured to be removed from said emergency door opening system to permit the insertion of a different display module, which different display module is configured to alter the function of said emergency door opening system.

12. The emergency door opening system according to claim 11, wherein said display module has a plate located in a mounting frame, on which plate there is at least one visual alarm or luminous element that indicate the status of the locking device.

13. The emergency door opening system according to claim 12, wherein said cover frame is fastened to said mounting frame.

14. The emergency door operating system according to claim 13, wherein said visual alarm is a flashing light such as a strobe light.

15. The emergency door opening system according to claim 14, wherein said visual alarm is surrounded by a reflector.

16. The emergency door opening system according to claim 15, wherein light from said visual alarm is fed into a fiber optics structure.

17. The emergency door opening system according to claim 16, wherein said housing, said cover frame, and said mounting frame at least partly comprise at least one of substantially translucent areas or fiber optics structures.

18. The emergency door opening system according to claim 17, wherein said fiber optics structures or substantially translucent areas are fastened detachably.

19. The emergency door opening system according to claim 18, wherein said cover frame can be detached at least over portions of its surface, whereby a signal is emitted in the event of an unauthorized removal of said cover frame.

20. The emergency door opening system according to claim 19, wherein said display module is located so that it projects with reference to said housing of said emergency door opening system.

* * * * *